US008199946B2

(12) United States Patent
Ritter et al.

(10) Patent No.: US 8,199,946 B2
(45) Date of Patent: Jun. 12, 2012

(54) HEARING AID WITH RADIO FREQUENCY IDENTIFICATION RECEIVER FOR SWITCHING A TRANSMISSION CHARACTERISTIC

(75) Inventors: Hartmut Ritter, Neunkirchen am Brand (DE); Tom Weidner, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1306 days.

(21) Appl. No.: 11/881,378

(22) Filed: Jul. 26, 2007

(65) Prior Publication Data

US 2008/0025537 A1 Jan. 31, 2008

(30) Foreign Application Priority Data

Jul. 28, 2006 (DE) ..... 10 2006 035 007

(51) Int. Cl.
*H04R 25/00* (2006.01)

(52) U.S. Cl. ..... 381/314; 381/315

(58) Field of Classification Search ..... 381/314, 381/327, 315

See application file for complete search history.

(56) References Cited

U.S. PATENT DOCUMENTS

| | | | | |
|---|---|---|---|---|
| 6,870,940 | B2 | 3/2005 | Meyer et al. | |
| 7,787,648 | B1 * | 8/2010 | Frerking et al. | 381/317 |
| 2002/0044669 | A1 | 4/2002 | Meyer et al. | |
| 2005/0286734 | A1 * | 12/2005 | Wang | 381/381 |
| 2006/0044140 | A1 | 3/2006 | Berg | |

FOREIGN PATENT DOCUMENTS

| | | | |
|---|---|---|---|
| CA | 2 476 364 | A1 | 1/2006 |
| DE | 10048341 | C1 | 4/2002 |
| EP | 0 681 411 | B1 | 5/1994 |
| EP | 1 638 367 | A2 | 12/2005 |
| EP | 1701585 | A2 | 9/2006 |

OTHER PUBLICATIONS

Birari et al., "Mitigating the Reader Collision Problem in RFID Networks with Mobile Readers", Networks, 2005. Jointly held with the 2005 IEEE 7th Malaysia International Conference on Communication., 2005 13th IEEE International Conference on, vol. 1, pp. 463-468, Nov. 16-18, 2005.*

Christoph Poerschmann; Juergen Carsten, "Automatische Einstellung der Parameter eines mobilen Endgeraets fuer Traeger von Hoergeraeten mit Hllfe von RFID" IP.COM Journal, IP.COM Inc., West Henrietta, NY, US, Oct. 25, 2004, 1 pg. + Statement of Relevance of NPL Document.

* cited by examiner

*Primary Examiner* — Jerome Jackson, Jr.
*Assistant Examiner* — Yu Chen

(57) ABSTRACT

The invention relates to a hearing aid with a sound receiver for generating a microphone signal representing a sound wave received and a sound generator for generating a sound depending on a power signal received. The hearing aid has a transmission unit which on the input side is connected to the sound receiver and on the output side to the sound generator and generates a power signal depending on a microphone signal received. The transmission unit modifies a transmission characteristic of the transmission unit as a function of a tag signal received. The hearing aid has a radio frequency detection device connected to the transmission unit, with a spatial detection zone where the radio frequency detection device detects, electromagnetically and in particular inductively, a radio frequency tag and, depending on the radio frequency tag, to generate a tag signal and to output this to the transmission unit.

8 Claims, 1 Drawing Sheet

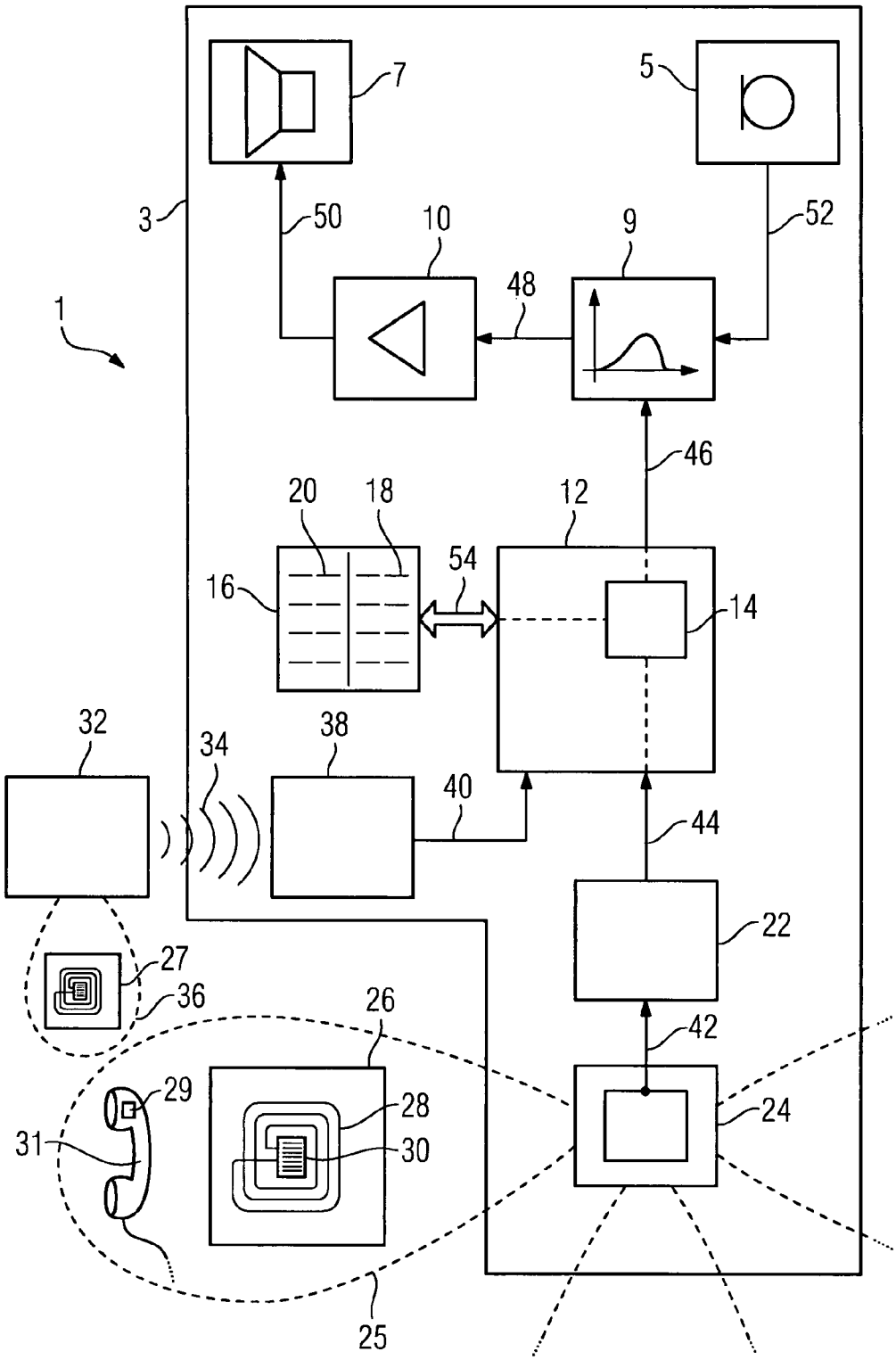
7
5
3
50
10
9
52
48
1
46
20
18
12
54
16
14
32
34
38
40
44
22
27
36
26
42
29
28
24
31
30
25

HEARING AID WITH RADIO FREQUENCY IDENTIFICATION RECEIVER FOR SWITCHING A TRANSMISSION CHARACTERISTIC

CROSS REFERENCE TO RELATED APPLICATIONS

This application claims priority of German application No. 10 2006 035 007.3 filed Jul. 28, 2006, which is incorporated by reference herein in its entirety.

FIELD OF THE INVENTION

The invention relates to a hearing aid with a sound receiver and a sound generator.

BACKGROUND OF THE INVENTION

Hearing aids known from the prior art have hearing programs which differ from one another, each of which corresponds to a predefined transmission characteristic of the hearing aid, in particular a frequency-dependent one. An application example of the switching over of a predefined hearing program is the operation of the hearing aid during a telephone call. Hearing aids known from the prior art are designed to switch over to another program when a telephone handset is brought near to the hearing aid, whereby for this purpose hearing aids known from the prior art have a sensor for detecting a magnetic field. The telephone handset has a permanent magnet to create a magnetic field, to switch over to another program. Hearing aids known from the prior art can have, for example, a REED contact or a GMR sensor (GMR=giant magneto-resistive) for detecting a magnetic field to switch over a hearing program.

Such small magnets, which are however strong, produce an unpleasant whistling if they are incorrectly positioned in the neighborhood of the hearing aid, due to feedback in an inductive coil used to detect a telephone signal, a so-called telecoil. Another problem can arise due to the fact that other external magnetic fields can cause an unintended switchover to another hearing program. As a further disadvantage, a sound generator can be irreversibly damaged by an external magnetic field.

SUMMARY OF THE INVENTION

The object underlying the invention is therefore to specify a hearing aid which does not have the problems mentioned above. This object is achieved by a hearing aid with a sound receiver and a sound generator where the sound receiver is designed to receive sound waves and to generate a microphone signal which represents the sound waves received. The sound generator of the hearing aid is designed to generate a sound which depends on a power signal received on the input side, where in particular the sound corresponds to the power signal.

The hearing aid has a transmission unit which is connected on the input side, at least indirectly, to the sound receiver, and on the output side, at least indirectly, to the sound generator.

The transmission unit is designed to generate a power signal, as a function of a microphone signal received on the input side, which at least partly corresponds to the microphone signal. For example, a power signal generated on the output side can be purged of interference signals, in particular by the transmission unit, and thus only partly correspond to the microphone signal.

The transmission unit is further designed to modify at least one transmission characteristic of the transmission unit as a function of a tag signal received on the input side.

The hearing aid has a radio frequency detection device, which on its output side has a working connection to the transmission unit, with a spatial detection zone for at least one radio frequency tag, where the radio frequency detection device is designed to detect, electromagnetically and in particular inductively, a radio frequency tag and, depending at least on the presence of a radio frequency tag in the detection zone, to generate at least one tag signal and to output this on its output side to the transmission unit.

The use of a radio frequency detection device for detecting a radio frequency tag is advantageous in that no external magnetic field is then necessary to cause a switchover of the hearing aid to another hearing program. A further advantage is that external magnetic fields cannot cause an unintended switchover to another hearing program.

In a preferred embodiment, the hearing aid is designed to generate the power signal in accordance with at least one predefined transfer function, as a function of at least one microphone signal frequency and/or one microphone signal amplitude.

For example, such a predefined transfer function can be represented by a hearing program. In the case of impaired-hearing patients whose hearing impairment is in the form of a permanent displacement of their hearing threshold (PTS=permanent threshold shift), a frequency-dependent modification of the transmission characteristics of the hearing aid is often necessary, in particular by the modification of an amplification factor for a transmission unit.

For example, the amplification factor can have a frequency-dependent adaptation to match the auditory threshold of the hearing aid wearer.

In a preferred embodiment the hearing aid is designed to keep available at least two transfer functions and to select, depending on the tag signal, exactly one of at least two transfer functions kept available and to generate the power signal, in accordance with the selected transfer function, as a function of the microphone signal's microphone signal frequency and/or a microphone signal amplitude.

It is preferable if, in this embodiment, the radio frequency detection device is designed to generate a tag signal which represents an item of tag data in a radio frequency tag which is detected.

It is further preferable if a tag signal can represent an item of tag data, in particular an item of tag class data which corresponds to a class of radio frequency tags.

It is advantageous that in this way the hearing aid can switch over to another hearing program which represents another transfer function if, for example, a radio frequency tag which is intended to effect a switchover to another hearing program is present in the detection zone of the radio frequency detection device.

For example, a radio frequency tag for switching over to a telephone hearing program can be affixed, in particular adhesively, to a telephone handset or built into the telephone handset so that, when the telephone handset is brought up to the hearing aid, the hearing device switches over to the appropriate hearing program for telephoning.

A second transfer function, or at least one transfer function which is kept available, can each be represented by a second, or at least one further, hearing program.

For example, a hearing aid can have a hearing program which corresponds to a transfer function for telephoning on a mobile telephone. A radio frequency tag can, for example, have a predefined item of tag data which can be read out or sensed when the radio frequency tag is detected by a radio frequency detection device.

The radio frequency detection device is designed to generate a tag signal which represents the item of tag data in the radio frequency tag which is detected.

In this way it is possible for radio frequency tags, each of which represents different items of tag data from the others, when they are detected by a radio frequency detection device, to generate tag signals which are different from each other.

Thus, for example, a radio frequency tag with an item of tag data for switching over to a telephone hearing program can select a predefined transfer function for telephoning, a radio frequency tag with an item of tag data for telephoning on a mobile telephone can for example, when it is detected, effect a switchover to a hearing program which represents a transfer function for telephoning on the mobile telephone.

A radio frequency tag for switching over to a mobile telephone hearing program can, for example, be arranged in the neighborhood of a mobile telephone, in particular can be fixed adhesively to a mobile telephone or built into or arranged in the mobile telephone.

A radio frequency tag can with advantage have an impedance to the passage of sound which does not significantly or not at all degrade the onward transmission through the radio frequency tag of sound which represents speech, in particular in the frequency range between 100 Hertz and 4000 Hertz. For example, for this purpose a radio frequency tag can be perforated or have a thin membrane, preferably with a thickness of less than 10 grams per square meter, even more preferably less than 5 grams per square meter, especially preferably less than 2 grams per square meter. The membrane can be of polyamide, polyester, polyethylene or polypropylene.

Such a radio frequency tag can with advantage be attached adhesively to a telephone handset and for this purpose have an adhesive coating.

In an advantageous embodiment, the hearing aid has an assignment unit which has a working connection on its input side to the radio frequency detection device and on its output side to the transmission device. In this embodiment, the hearing aid also has, connected to the assignment unit, a look-up memory for at least two assignment datasets, where each assignment dataset represents an assignment of exactly one tag or a class of tags to exactly one transfer function. The assignment unit is designed to evaluate the tag signal and to select an assignment data set which corresponds to the tag signal and to generate a transfer signal which corresponds to a predefined transfer function represented by the selected assignment dataset, and to output the transfer signal to the transmission unit for the purpose of selecting the predefined transfer function.

It is advantageously possible in this way to effect an assignment of an item of tag data to a predefined transfer function.

An item of tag class data representing a class can, for example, be assigned to a predefined hearing program and thus to exactly one predefined transfer function in such a way that radio frequency tags, each of which belongs to one class and has the same item of tag class data, is each assigned to exactly one predefined transfer function.

A radio frequency tag can represent, in addition to an item of tag class data, an item of individual tag data for switching an individual transfer function.

The invention also relates to a program system. A program system, including a hearing aid of the type described above, can have at least one radio frequency tag which in each case is assigned to a predefined hearing program, or have at least two radio frequency tags, each of which is assigned to hearing programs or transfer functions, as appropriate, which differ from one another.

A program system can with advantage have at least one radio frequency tag, where the radio frequency tag represents at least two items of tag data which differ from one another and where the at least two items of tag data are each assigned to appropriately predefined transfer functions which differ from one another.

For example, the program system can with advantage include at least two radio frequency tags, each of which represents an item of tag class data corresponding to one class and hence is each assigned to the same class transfer function.

For example, radio frequency tags, each of which represents an item of tag class data within one class, can be attached to different telephones and thus in each case be assigned to the same hearing program.

In another embodiment, the hearing aid can select and/or switch between at least two transfer functions. For example, a first transfer function of the hearing aid can be assigned to a predefined class of tag data items and a second transfer function can be assigned to exactly one individual item of tag data.

In this way it is advantageously possible, for example, to switch to a first transfer function for all telephones and, by switching to a second transfer function, to effect an individual adaptation to a particular type of telephone.

In an advantageous embodiment, a hearing aid of the type described above is a component of a pair of spectacles and the radio frequency detection device has an antenna for detecting a radio frequency tag, where the antenna is at least partly integrated into a spectacle frame and/or into a sidearm of the spectacles.

By integrating an antenna into a pair of spectacles or a component of a pair of spectacles, it is possible with advantage to enlarge the detection range of a radio frequency detection device.

A hearing aid can be an in-the-ear hearing aid or a behind-the-ear hearing aid.

The invention also relates to a programming system, including a hearing aid of the type described above. The programming system includes, apart from the hearing aid, a programming device for programming a radio frequency tag, where the programming device is designed to program at least one radio frequency tag with at least one predefined item of tag data, which is provided for generating a tag signal for selecting a predefined transfer function of the hearing aid.

In a preferred embodiment, the programming device can with advantage be designed to program a radio frequency tag with a first item of tag data, which corresponds to a class of radio frequency tags. Here, a class is assigned to a predefined transfer function. It is further preferred that the programming device can be designed to program a radio frequency tag with a second item of tag data which is assigned to exactly one predefined transfer function, and thus to exactly one hearing program.

A programming device for a programming system can advantageously be designed for programming the hearing aid.

The programming device can further be designed to program the hearing aid for detecting at least one radio frequency tag with at least one predefined item of tag data.

The hearing aid for such a programming system is designed to be programmable in such a way that it can store away an assignment dataset, which represents the tag data, for the purpose of assigning a predefined transfer function to the tag data.

A radio frequency detection device will preferably have a transmitter for emitting transmission energy to a radio frequency tag.

The radio frequency tag will preferably have a receiver for receiving and storing the transmission energy. The radio frequency tag will also have a transmitter for generating a transmission signal which represents an item of tag data.

When the transmission signal which represents an item of tag data is transmitted, the radio frequency tag's transmitter and the radio frequency detection device can work with one of the modulation methods below or with a combination of the modulation methods below:

FM (FM=frequency modulation)
AM (AM=amplitude modulation)
FSK (FSK=frequency shift keying)
ASK (ASK=amplitude shift keying)
PSK (PSK=phase shift keying)

The radio frequency detection device will preferably be designed to carry out a pulsed detection of a radio frequency tag. It is further preferred if the radio frequency detection device is designed to carry out the pulsed non-detection with a pulse pause of two seconds, or advantageously one second.

The radio frequency detection device will preferably be designed to carry out the pulsed detection with a pulse duration of less than 50 milliseconds, preferably less than 10 milliseconds, especially preferably less than one millisecond.

Exemplary forms of embodiment of a radio frequency detection device work with a carrier frequency of 125 kilohertz, 13.56 megahertz or in the range of 860-980 megahertz. Carrier frequencies in the range from one to five gigahertz are also conceivable Pulsed detection is advantageous in enabling energy to be saved.

In a preferred embodiment, the radio frequency tag is designed to be programmable, and has a transceiver. The radio frequency tag can receive and store a tag data signal via a receiver in the transceiver. The transceiver's transmitter can generate a transmission signal which represents the tag data. The transceiver's transmitter and receiver can each work in accordance with one of the above-mentioned modulation methods.

It is advantageous if the hearing aid can effect switching, in particular the switching on and/or off of the hearing aid to save energy, as a function of a tag signal, in particular the presence of one or a predetermined tag signal.

The invention also relates to a method for altering at least one transmission characteristic of a hearing aid, where the transmission characteristic represents a relationship between an output sound and a sound wave which is sensed, including the steps:

electromagnetic detection of a tag, in particular a radio frequency tag, in a detection zone for the hearing aid;

changing the transmission characteristic as a function at least of the presence of a tag in the detection zone.

The method can preferably include the steps:

keeping available at least two transfer functions which differ from one another, each of which represents transmission characteristics which differ from each other;

selection, depending on a tag which is detected, in particular a radio frequency tag, of a transfer function which is kept available;

changing the transmission characteristic of the hearing aid according to the selected transfer function.

BRIEF DESCRIPTION OF THE DRAWINGS

The invention will now be explained below by reference to FIGURES and further exemplary embodiments.

Figure shows—schematically—an exemplary embodiment for a system 1, including a hearing aid 3 and a programming device 32.

DETAILED DESCRIPTION OF THE INVENTION

The hearing aid 3 has a sound receiver 5, which is designed to receive sound waves and to generate a microphone signal which depends on the sound waves received and which represents the sound waves received.

The hearing aid 3 also has a sound generator 7, which is designed to generate a sound which depends on a power signal received on its input side.

The hearing aid 3 also has a transmission unit 9, which on the input side is connected to the sound receiver 5 via a connecting line 52 and on the output side is connected, at least indirectly, to the sound generator 7.

The transmission unit 9 is designed to generate an output signal, in accordance with at least one predefined transfer function, which depends on a microphone signal received on the input side and which represents at least partly the microphone signal.

On its output side, the transmission unit 9 is connected via a connecting line 48 to an amplifier 10, which is designed to generate an amplified power signal which depends on and corresponds to an input signal received on its input side, and to output the power signal on its output side.

On its output side, the amplifier 10 is connected via a connecting line 50 to the sound generator 7.

The transmission unit 9 can, for example, take the form of a digital signal processor, which is designed to modify a characteristic for the transmission of a microphone signal received on the input side, the modification depending on filter ratios received on the input side.

A transmission unit can include the transmission unit 9 and the amplifier 10.

In this exemplary embodiment, the hearing aid 3 also includes a central processing unit 12, an assignment unit 14, a look-up memory for storing assignment datasets 18 and 20, where the assignment memory 16 is connected to the central processing unit 12 via a bidirectional databus 54.

In this exemplary embodiment, the hearing aid 3 also includes a radio frequency detection device 22 for detecting a radio frequency tag. The radio frequency detection device 22, also referred to below as an RFID receiver, is on its input side connected via a connecting line 42 to an antenna 24 for detecting a radio frequency tag 26. The RFID receiver 22 is designed to detect the radio frequency tag 26 inductively, via the antenna 24, and to generate a tag signal which represents an item of tag data for the radio frequency tag 26.

On its input side, the central processing unit 12 is connected via a connecting line 44 to the RFID receiver 22. On its output side, the RFID receiver 22 is designed to transmit the tag signal to the central processing unit 12, via the connecting line 44.

On its input side, the central processing unit 12 is connected via a connecting line 40 to an interface 38.

In this exemplary embodiment, the interface 38 is an infrared interface, in particular an IrDA interface (IrDA=Infrared Data Association). The interface 38 is designed for receiving, in particular receiving cordlessly, a data signal 34. The system 1 also includes a programming device 32, which is designed for emitting the data signal 34. The data signal 34 represents an item of tag data for a radio frequency tag. The programming device is further designed to program an unprogrammed radio frequency tag 27—which does not yet have any tag data and is within the detection zone 36 of the programming device 32—with an item of tag data which is provided for assigning to a transfer function.

The central processing unit is designed to generate, depending on a data signal received on the input side via the connecting line 40, an assignment dataset which corresponds to the tag data represented by the data signal and to a transfer function assigned to the tag data.

The central processing unit 12 is designed to store away the assignment dataset, via the bidirectional databus 54, in the look-up memory 16. In this exemplary embodiment, the assignment dataset includes a tag dataset 18 and a transfer dataset 20 assigned to it.

The way in which the system 1 functions will now be explained below:

A radio frequency tag 26 can be present, for example, within a detection zone 25 of the antenna 24 of the RFID receiver 22. The radio frequency tag 26 has a transmission and receiving antenna 28, which is connected to a chip 30. In the chip 30 is stored an item of tag data—which has for example as previously described been generated by the programming device 32 and stored away in the chip 30. The RFID receiver 22 can emit transmission energy via the antenna 24, which is received by the antenna 28 of the radio frequency tag 26, and can be stored for use in transmitting back a tag signal. The radio frequency tag 26 is designed to generate, using the previously received and stored transmission energy, a tag signal representing the tag data, and to transmit this back to the RFID receiver 22 via the antenna 28.

The tag signal transmitted back in this way can be received via the antenna 24 and the RFID receiver 22, and transmitted via the connecting line 44 to the central processing unit 12.

The central processing unit 12 can compare the tag signal, received on the input side via the connecting line 44, with assignment datasets stored away in the look-up memory 16 and, if the received tag signal matches a tag dataset 18 in an assignment dataset, generate a transfer signal which corresponds to an appropriate transfer dataset 20 in the assignment dataset.

The central processing unit 12 can have an assignment unit 14 for the purpose of comparing a tag signal on its input side with an assignment dataset. The assignment unit 14 is connected—as indicated by dashed lines—with the connecting line 44 and with the bidirectional databus 54, and on its output side with the connecting line 46.

The transfer signal can, for example, represent filter ratios a(0) . . . a(n) for setting a digital filter in the transmission unit 9.

As an alternative to this, predefined transfer functions can be stored away in the transmission unit 9, and the transfer signal can correspond to a predefined transfer function. The transmission unit 9 can then select, depending on a transfer signal received on the input side, a predefined transfer function for generating an output signal which depends on a microphone signal received on the input side, and switch it into a transmission path.

Also shown by way of example is a telephone handset 31 with a radio frequency tag 29 affixed on or in it. The radio frequency tag 29 is located within the detection zone 25 of the antenna 24, the telephone handset 31 is located at least partly within the detection zone 25 of the antenna 24.

The invention claimed is:

1. A hearing aid, comprising:

a sound receiver that receives a sound wave and generates a microphone signal representing the sound wave;

a sound generator that generates a sound depending on a power signal;

a transmission unit connected between the sound receiver and the sound generator that:

generates the power signal depending on the microphone signal, and modifies a transmission characteristic of the transmission unit as a function of a tag signal; and an RFID receiver connected to the transmission unit that generates the tag signal based on a radio frequency tag presented and electromagnetically detected in a detection zone, wherein the RFID receiver is configured to generate the tag signal based on one of a plurality of radio frequency tags attached to different telephones, wherein the transmission unit is configured to generate the power signal based on a transfer function and a frequency or an amplitude of the microphone signal, wherein the transfer function is selected from at least two transfer functions based on the tag signal, wherein a first transfer function is assigned to a predefined class of tag data items in the radio frequency tags, wherein a second transfer function is assigned to an individual item of tag data in the radio frequency tags, and wherein the hearing aid is configured to switch between the first transfer function for all the telephones and the second transfer function for an individual adaption to a particular type of telephone.

2. The hearing aid as claimed in claim 1, wherein the radio frequency tag comprises a transmitting and receiving antenna connected to a chip where an item of tag data in the radio frequency tag is stored.

3. The hearing aid as claimed in claim 2, wherein the RFID receiver generates the tag signal corresponding to the item of tag data.

4. The hearing aid as claimed in claim 1, further comprising:

an assignment unit connected between the RFID receiver and the transmission unit, a look-up memory connected to the assignment unit for storing assignment dataset representing an assignment of a predefined item of tag data or a class of tag data to a predefined transfer function.

5. The hearing aid as claimed in claim 4, wherein the assignment unit:

evaluates the tag signal, selects one assignment dataset from the look-up memory corresponding to the tag signal, generates a transfer signal corresponding to one predefined transfer function based on the selected assignment dataset, and outputs the transfer signal to the transmission unit for the modification.

6. The hearing aid as claimed in claim 1, wherein the RFID receiver detects the radio frequency tag based on a pulsed detection.

7. The hearing aid as claimed in claim 1, wherein the hearing aid is a component of a pair of vision spectacles.

8. The hearing aid as claimed in claim 7, wherein the RFID receiver comprises an antenna for detecting the radio frequency tag and the antenna is at least partly integrated into a frame or a sidearm of the vision spectacles.

* * * * *